US005351639A

United States Patent [19]

Ortelli

[11] Patent Number: 5,351,639

[45] Date of Patent: Oct. 4, 1994

[54] POSITIVE-ACTION DEVICE FOR BRINGING ABOUT THE ROTARY MOVEMENT OF A HATCH WITH SECURE LOCKING THEREOF IN THE OPEN POSITION

[75] Inventor: Aurelio Ortelli, Bologna, Italy

[73] Assignee: Riva Calzoni S.p.A., Milan, Italy

[21] Appl. No.: 96,020

[22] Filed: Jul. 22, 1993

[30] Foreign Application Priority Data

Aug. 5, 1992 [IT] Italy ..... MI92A001933

[51] Int. Cl.[5] ..... B63B 19/12

[52] U.S. Cl. ..... 114/203; 114/339; 114/340

[58] Field of Search ..... 114/339, 340, 201 R, 114/203; 312/24, 319.2; 187/62, 65

[56] References Cited

U.S. PATENT DOCUMENTS

| | | | |
|---|---|---|---|
| 749,755 | 1/1904 | Spear | 114/340 X |
| 867,982 | 10/1907 | Lake | 114/340 X |
| 1,873,243 | 8/1932 | Zebrowski | 49/112 |
| 3,044,106 | 7/1962 | Papsdorf | 16/179 |
| 3,179,010 | 4/1965 | Bratton | 89/107 |

FOREIGN PATENT DOCUMENTS

| | | | |
|---|---|---|---|
| 392968 | 12/1908 | France . | |
| 124454 | 4/1919 | United Kingdom . | |
| 1231486 | 5/1971 | United Kingdom | 114/244 |

*Primary Examiner*—Sherman Basinger
*Attorney, Agent, or Firm*—Herbert Dubno; Yuri Kateshov

[57] ABSTRACT

A positive-action device for bringing about the rotary movement of a hatch, as a result of the traversing stroke of a shaft moving axially within a fixed structure, particularly in submarine turrets, includes an actuating component integral with shaft and moving with the latter in a direction parallel to the longitudinal axis of the shaft, and an articulated kinematic mechanism the upper end of which is hinged to hatch with an interposed flexible safety device and the lower end of which is rotationally integral with a regulating component rotating around the axis of a fixed pivot, there being associated with the regulating component a mechanism of bistable type for reliably maintaining the settings corresponding to the open and closed positions of the hatch, and end-of-stroke devices.

7 Claims, 1 Drawing Sheet

POSITIVE-ACTION DEVICE FOR BRINGING ABOUT THE ROTARY MOVEMENT OF A HATCH WITH SECURE LOCKING THEREOF IN THE OPEN POSITION

FIELD OF THE INVENTION

My present invention relates to a positive action device for bringing about the controlled rotation of a hatch to seal housings of shafts, capable of moving axially, particularly in submarine turrets, for the opening and closure of the hatch as a result of the movement in axial direction of such shaft.

BACKGROUND OF THE INVENTION

It is known that submarines need to be provided with equipment such as sensors and the like, located at the free top-end of shafts which are raised when the submarine is at the periscope level and are made to retract into their own housing for a normal submerged operation.

Such housings obviously have a top opening which should be sealed by means of a hatch including either a single part or two parts, so as not to alter the hydrodynamic configuration of the structure of the submarine and at the same time to reduce the noise caused by vortices during normal submerged operation.

There are also known engineering solutions based on the use of independent actuating devices of hydraulic, pneumatic or electrical types capable of regulating independently the sequence of opening—outward movement—retraction and closure of the shaft and hatch. Such independence, however, requires that such devices be provided with means of control and regulation designed to prevent any error in such sequence, which error could cause interference between the shaft and hatch resulting in damage to the various parts.

Such means of control however, in addition to entailing higher costs and regular preventive maintenance to ensure the efficiency thereof, do not guarantee, because of their independence, efficient and reliable direct control of the aforedescribed sequence.

OBJECTS OF THE INVENTION

There is therefore posed the technical problem of providing a device to bring about the movement of a hatch rotating around an axis at right angles to the longitudinal axis of a shaft movable along the longitudinal axis and to be capable of ensuring in a reliable manner the sequence of movements of such shaft and hatch without the need for further auxiliary control devices.

Yet another object is to provide the device which brings about, with the hatch open, the mechanical locking of the device so as to prevent actions of hydrodynamic type from causing the hatch to rotate, resulting in possible interference with the shaft.

Still another object of the invention is to provide a handling device of simple and reliable construction made with a small number of constituent parts.

SUMMARY OF THE INVENTION

Such results are obtained with the present invention which provides a positive-action device for bringing about the rotary movement of a hatch as a result of the traversing stroke of a shaft moving axially within a fixed structure, particularly, in submarine turrets. The device comprises an actuating component integral with the shaft and moving therewith in a direction parallel to the longitudinal axis of the shaft, and an articulated kinematic mechanism the upper end of which is hinged to the hatch, with an interposed flexible safety feature, and the lower end of which is rotationally integral with a regulating component rotating around the axis of a fixed pivot.

The regulating component is provided with a mechanism of bistable type for reliably maintaining the settings corresponding to the open and closed positions of the hatch and end-of-stroke devices. Such kinematic mechanism is furthermore capable of lining up, in the open hatch position, with axes of the actual component operating the regulating device, located outside the axis of the pivot around which turns the regulating component and of the part which determines the rotation of the latter toward the end-of-stroke devices.

In a preferred embodiment of the positive-action device according to the invention provision is made for such regulating component to be preferably comprised of a pivot integral with the shaft and for such articulated kinematic mechanism to comprise a central bar guided by bushes and integral at both ends with a connecting rod respectively linked to the hatch and to the regulating component.

More particularly, such regulating component is preferably comprised of a fork rotating around a fixed pivot integral with the structure under the action of pressure exerted by the regulating component. Furthermore, provision is made for the bistable mechanism to be preferably comprised of a bar, hinged to a fixed pivot and coaxially to which is located a preloaded spring capable of maintaining the condition of maximum extension at the two end positions determined by the rotation of the regulating component.

In the positive-action device according to the invention the flexible component comprises a hollow body integral with the hatch and an internal slider integral with the connecting rod and capable of compressing a spring to compensate for errors of movement of the pivot during closure and to provide an end-of-stroke feature safeguarding against locking of the hatch in the open position.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
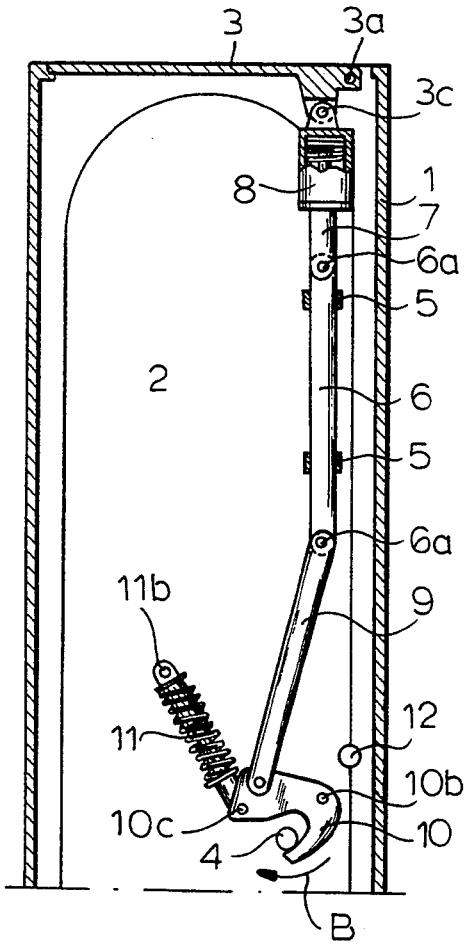
FIG. 1 is the axial sectional view of the drawing with the hatch closed.

As shown in FIG. 1 in schematic form, within a fixed guiding structure 1 is located a shaft 2, capable of moving in an axial direction A. Structure 1 is closed at the top by a hatch 3 hinged at 3*a* to the structure.

To shaft 2 is provided with a pivot 4 fixedly mounted thereon and which, as will become more clearly apparent hereinafter, is capable of bringing about the movement of hatch 3.

To structure 1 is formed with two bushes 5 guiding a bar 6 parallel to the longitudinal axis of the shaft, the upper end of the bar is hinged by means of a pivot 6*a* to the lower end of a connecting rod 7 with its upper end hinged with an interposed flexible component 8 to hatch 3.

The flexible component 8 is substantially comprised of a hollow body 8*a* mounted pivotally by a pivot 3*c* on the hatch 3, and a slider 8*b* the lower end of which is integral with connecting rod 7.

Figure 2:
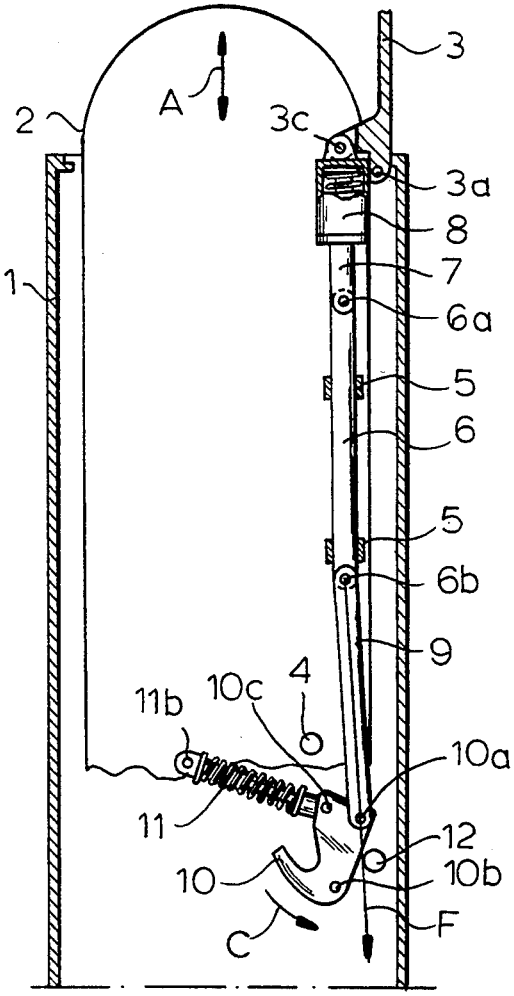
FIG. 2 is the device according to FIG. 1 and shown in the open hatch position and with the shaft protruding from the housing.
Figure 1A:
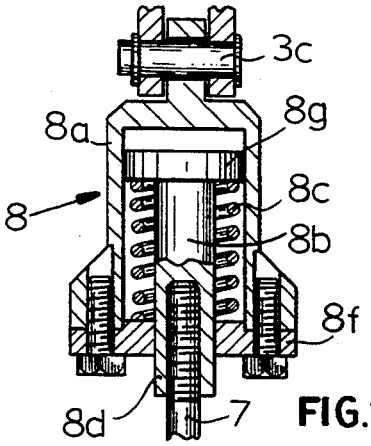
FIG. 1*a* is a detail of the spring device illustrated in the closed position of the hatch.
Figure 2A:
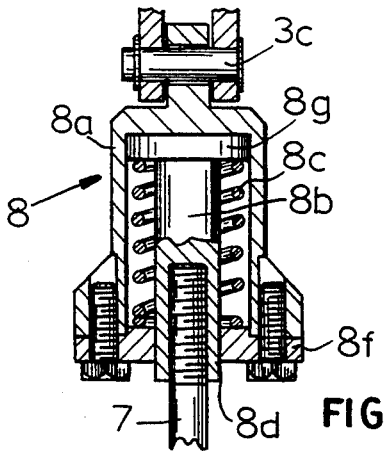
FIG. 2*a* is a detail of the spring device illustrated in the open position of the hatch.

The other end of slider 8*b* is instead shaped in such a way as to constitute both a supporting base 8*g* for a spring 8*c*, acting on such end and on a further surface 8*d* opposed by a component 8*f* of lower closure of hollow body 8*a* (FIGS. 1*a*, 2*a*) and the surface of impact of the end-of-stroke device against the corresponding internal surface of hollow body 8*a* (FIG. 2*a*). With such configuration, flexible component 8 constitutes a device with internal end-of-stroke features capable of bringing about, in the event of application of a force exceeding a preset value, the compression of spring 8*c* but not the extension thereof. In other words the flexible component 8 as a whole may be elongated but its preset minimum length may not be reduced, thus facilitating compensation for errors of tolerance in the length of the closing stroke, but not the rotation toward shaft 2 of hatch 3, when the latter is open which rotation could be caused by hydrodynamic forces acting on the said hatch. In such event (FIG. 2*a*) the upper end of slider 8*b* acts against the walls of body 8*a* to prevent rotation of the hatch in the direction of closure.

The opposite end of bar 6 is hinged by means of a pivot 6*b* to a second lower connecting rod 9, the lower end of which, in turn, is hinged via a pivot 10*a* to a fork 10 mounted pivotally on the fixed structure or housing 1 by a fixed pivot 10*b* around which it can rotate.

To such fork is also hinged, via a pivot 10*c*, a spring mechanism 11 the other end of which is hinged to a pivot 11*b* fixed to the structure. The spring mechanism 11 is of the type capable of assuming a stable configuration only at extreme angular positions, in any other position of the arc of rotation thereof around pivot 11*b* it is under conditions of instability determined by the pushing action of the spring which tends to assume its own position of maximum extension.

The housing 1 is also provided with a further pivot or stud 12 which, as will be more clearly explained hereinafter, forms the end-of-stroke block of fork 10.

The operation of the device is as follows:

When the submarine, not illustrated, is travelling submerged, the hatch is closed (FIG. 1, 1*a*), so that shaft 2 is lowered and actuating pivot 4 integral therewith is engaged with fork 10 (FIG. 1) which is pushed by spring mechanism 11 into the stable position along a direction indicated by an arrow B toward the bottom of the figure.

When the order is given to raise shaft 2—operated by actuators which are self-evident and therefore not illustrated—the latter (FIG. 2) initiates its upward stroke carrying with it pivot 4 which forces fork 10 to rotate in a direction B around fixed pivot 10*b* thus setting in motion connecting rod 9 which raises bar 6, the latter, in turn, operates connecting rod 7 which causes the rotation of hatch 3; into the open position. The rotation of fork 10 furthermore brings about the rotation of spring mechanism 11 which tends to assume its stable upper position (FIG. 2) forcing fork 10 to act against end-of-stroke pivot 12.

In such open position the hatch is subjected to a dual safeguarding action: firstly due to flexible component 8, slider 8*b* of which, located at the end of stroke, acting against hollow body 8*a*thereby preventing rotation in the direction of closure not regulated by the kinematic chain, and secondly due to the fact that the axis of connecting rod 9, marked "F" in FIG. 2, passes beyond fixed pivot 10*b* so that any transverse thrust acting on the hatch in its direction of closure imparts a force to the connecting rod which then tends to apply the pressure of the fork against end-of-stroke pivot 12, or to prevent changing of the position of the hatch, the maintenance of this position being subsequently brought about by the action of bistable device 11 which, as has been stated, tends to maintain the fork pressed against end-of-stroke pivot 12.

Such position is maintained in a compulsory manner until the shaft has completed a stroke such as to cause pivot to act again on fork 10 thus bringing about rotation in the direction C opposite the previous one (FIG. 2), thereby initiating the entire reverse sequence of the kinematic chain—connecting rod 9, bar 6, connecting rod 7, spring mechanism 11—which then returns to the position illustrated in FIG. 1 forcing hatch 3 into the closed position. Any abnormal stresses likely to result from the inevitable inaccuracies of the setting of pivot 4 in its lower end-of-stroke position are then compensated for by spring 8*c*, which may become compressed under the pulling action exerted by the kinematic mechanism on slider 8*b*.

It is therefore clear that with the device according to the invention there is substantially eliminated the risk of interference between the hatch and shaft during both outward movement and retraction of the latter.

The mechanical link actuated by the device described above is thus capable of imparting, in both directions, direct and positive action from shaft 2 to the kinematic chain so as to ensure the absence of interference between the shaft and the hatch without necessitating further auxiliary safety devices and at the same time ensuring maintenance in a secure manner of the open and closed positions of the said hatch.

Many variants may be introduced to the detailed implementation of the device according to the invention without thereby departing from the scope of protection of this invention.

I claim:

1. A hatch with a positive-action locking device, comprising:

a housing extending along a longitudinal axis;

a cover pivotally mounted on said housing between a closed position corresponding to closure of the hatch and an open position;

an axially displaceable shaft in said housing shiftable between outward and inward positions;

an articulated kinematic mechanism in said housing including:

a resilient body hinged to the cover in said housing, and link means operatively connected with said resilient body for displacing same;

a fulcrum fixed on said housing;

bistable means articulated to said housing for maintaining said open and closed positions of said cover;

a regulating element mounted pivotally on said fulcrum and operatively connected with said bistable means and with said link means for displacing said link means linearly and for swinging said link means from one side to another past alignment with said fulcrum upon displacement of said regulating element from a position corresponding to the closed position of said cover to a position corresponding to said open position of said cover; and an actuator on said shaft engageable with said regulating element upon shifting said shaft to the inward position for displacing said regulating element.

2. The hatch defined in claim 1 wherein said link means includes:

an outer link operatively connected with said resilient body, an intermediary link operatively connected with the outer link and movable therewith, an inward link mounted pivotally on said intermediary link by one end thereof and on said regulating element by an opposite end, and a plurality of bushes slidably engaging said intermediary link for axial guiding thereof.

3. The hatch defined in claim 1 wherein said regulating element is a fork.

4. The hatch defined in claim 1 wherein said bistable means includes:

a bar provided with one end hinged to said shaft, and a preloaded spring on said bar maintaining the condition of maximum extension at respective positions corresponding to open and closed positions of said cover.

5. The hatch defined in claim 1 wherein said resilient body includes a hollow casing connected with said cover and an internal slider fixed to said link means and provided with:

a shank formed with an upper surface extending radially outwardly from said shank and pressing against a stopping surface of said hollow casing upon opening of said cover, and a respective spring on said pin for compensating errors of said actuator during said inward stroke.

6. The hatch defined in claim 1, further comprising a stop mounted fixedly on said housing and spaced axially inwardly from said cover, said regulating element being urged against said stop and said link means pressing against said resilient body upon reaching said open position by said cover, preventing thereby involuntary closure of said cover.

7. The hatch defined in claim 1 wherein said actuator is a pin.

* * * * *